US005615500A

United States Patent [19]

Moalem et al.

[11] Patent Number: 5,615,500

[45] Date of Patent: Apr. 1, 1997

[54] IRON WITH IMPROVED CONNECTION OF SOLEPLATE AND STEAM CHAMBER COVER

[75] Inventors: Farhad Moalem, Bethesda, Md.; Benjamin H. Bain, Jr., Shelton; Joseph J. Caselli, Stratford, both of Conn.

[73] Assignee: Black & Decker Inc., Newark, Del.

[21] Appl. No.: 552,819

[22] Filed: Nov. 3, 1995

[51] Int. Cl.[6] ..... D06F 75/06

[52] U.S. Cl. ..... 38/77.83; 38/88; 29/509

[58] Field of Search ..... 38/77.83, 88, 77.82, 38/93; 29/411, 445, 462, 509, 515, 525.1, 283.5, 707, 709, 715

[56] References Cited

U.S. PATENT DOCUMENTS

| | | | |
|---|---|---|---|
| 1,459,548 | 6/1923 | Morison | 29/508 |
| 1,840,764 | 1/1932 | Brown | 29/508 |
| 2,846,793 | 8/1958 | Struder | 38/77 |
| 3,000,093 | 9/1961 | Wredenfors | 29/505 |
| 3,191,268 | 6/1965 | Matea | 29/155.5 |
| 3,260,005 | 7/1966 | Loomis | 38/77 |
| 3,290,077 | 12/1966 | Barge | 287/189.36 |
| 3,338,456 | 8/1967 | Kinnavy et al. | 220/42 |
| 3,341,932 | 9/1967 | Haller | 29/432 |
| 3,374,014 | 3/1968 | Kull et al. | 287/20.3 |
| 3,602,980 | 9/1971 | Heffner | 29/509 |
| 3,930,325 | 1/1976 | Schaeffer et al. | 38/77.83 |
| 4,057,885 | 11/1977 | Giger et al. | 29/177 |
| 4,240,217 | 12/1980 | Schwob | 38/77.83 |
| 4,277,900 | 7/1981 | Gowdy | 38/77.83 |
| 4,378,174 | 3/1983 | Hesse | 403/274 |
| 4,389,766 | 6/1983 | Capuano | 29/432.2 |
| 4,414,766 | 11/1983 | Schwob | 38/93 X |
| 4,471,541 | 9/1984 | Schwob | 38/77.8 |
| 4,564,986 | 1/1986 | Peterson | 29/509 X |
| 4,642,870 | 2/1987 | Schulz | 29/509 |
| 4,711,010 | 12/1987 | Walter | 38/77.8 X |
| 4,966,512 | 10/1990 | Takaku | 29/509 X |
| 4,995,177 | 2/1991 | Louison et al. | 38/88 |
| 5,079,823 | 1/1992 | Walter et al. | 29/509 |
| 5,146,700 | 9/1992 | Prosser | 38/77.9 |
| 5,390,432 | 2/1995 | Boulud et al. | 38/77.83 |
| 5,487,215 | 1/1996 | Ladouceur | 29/707 X |

*Primary Examiner*—Ismael Izaguirre
*Attorney, Agent, or Firm*—Barry E. Deutsch

[57] ABSTRACT

An iron having a steam chamber cover connected to the soleplate without the use of additional fasteners or adhesives. The soleplate has a raised steam chamber wall. A top of the steam chamber wall has a channel. A rim of the steam chamber cover is positioned in the channel and a portion of the wall is deformed to sealingly lock the rim in the channel. The cover can also be stamped towards the soleplate to press the cover against ribs of the soleplate inside the steam chamber.

18 Claims, 5 Drawing Sheets

FIG. 1
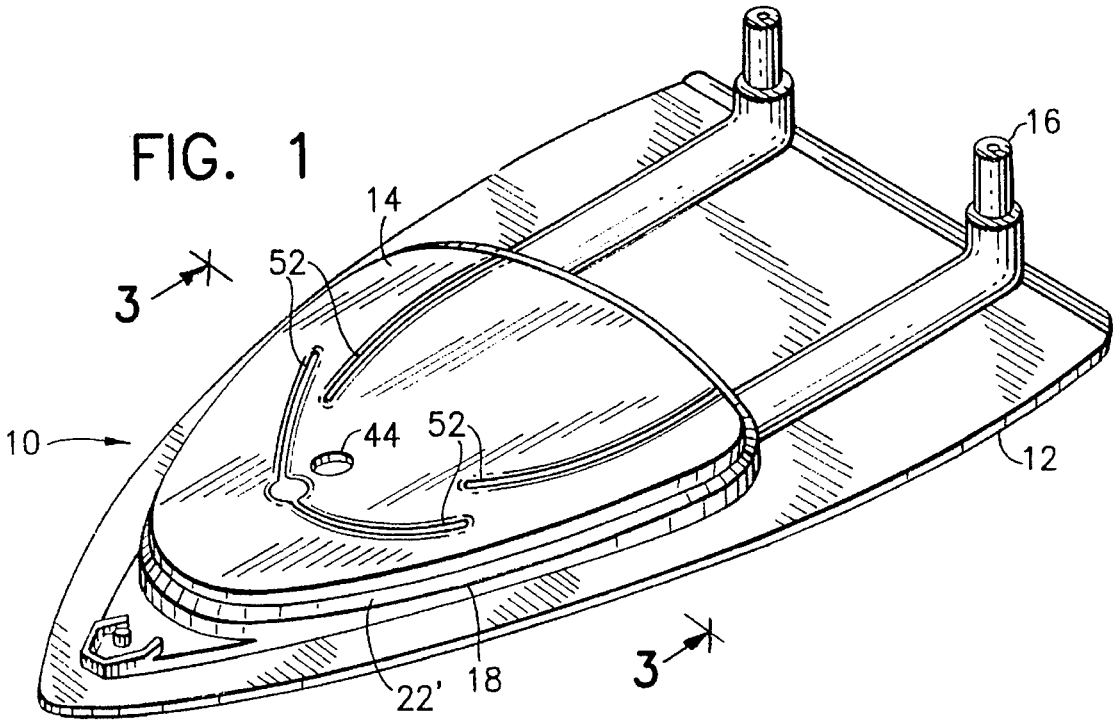
FIG. 3
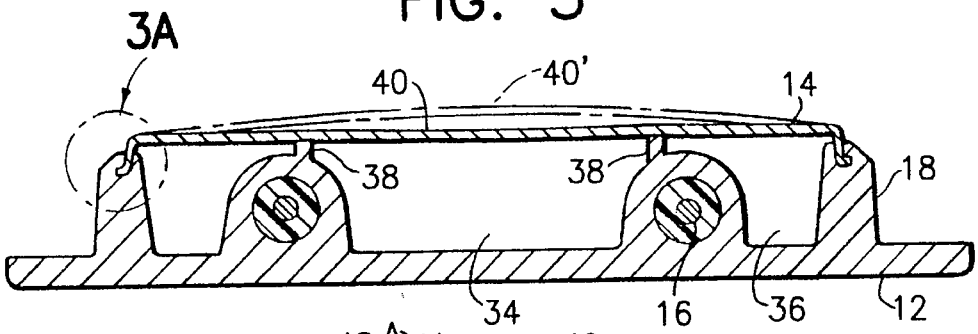
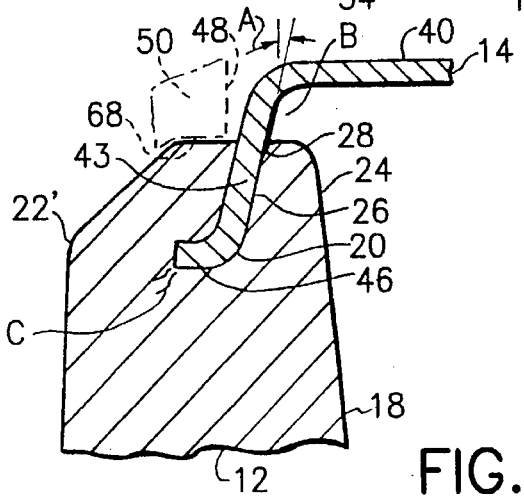
FIG. 3A

IRON WITH IMPROVED CONNECTION OF SOLEPLATE AND STEAM CHAMBER COVER

BACKGROUND OF THE INVENTION

1. Field of the Invention

This invention relates to steam irons and, more particularly, to an improved steam chamber cover and soleplate connection and the method of making the connection.

2. Prior Art

U.S. Pat. No. 4,471,541 discloses a steam iron where a peripheral flange of a cover is located in a channel of the soleplate. A pressure roller is then used to deform one edge of the soleplate at the channel against the flange of the cover. Other U.S. Patents that disclose various connections of steam chamber covers to soleplates include the following:

| | |
|---|---|
| U.S. Pat. No. 2,846,793 | U.S. Pat. No. 3,260,005 |
| U.S. Pat. No. 3,930,325 | U.S. Pat. No. 4,240,217 |
| U.S. Pat. No. 4,277,900 | U.S. Pat. No. 4,995,177 |
| U.S. Pat. No. 5,079,823 | U.S. Pat. No. 5,146,700 |

SUMMARY OF THE INVENTION

In accordance with one embodiment of the present invention in a soleplate for an iron, the soleplate having a steam chamber wall, the improvement comprises the top of the steam chamber wall having a channel therein with an outer wall section on a first side of the channel and an inner wall section on a second side of the channel, wherein the inner wall section is lower than the outer wall section. In accordance with another embodiment of the present invention an iron is provided comprising a steam chamber cover and a soleplate. The soleplate has a perimeter of the cover located in a channel of the soleplate. The channel extends into a portion of a top of the soleplate. The portion has a first section located on an outer side of the channel and a second section located on an inner side of the channel. The first section is initially higher than the second section and it is deformed against the perimeter of the cover wherein the inside and outside sections have substantially the same height.

In accordance with one method of the present invention a method of assembling an iron is provided comprising steps of providing a soleplate with a channel on its top, a first section of the soleplate at a first side of the channel being higher than a second section of the soleplate at a second side of the channel; locating a steam chamber cover on the top of the soleplate, the cover having a rim that is located inside the channel; and deforming the first section of the soleplate into the channel to sandwich the rim between the first and second sections of the soleplates.

In accordance with another method of the present invention a method of assembling an iron is provided comprising steps of connecting a steam chamber cover to a soleplate by deforming a portion of the soleplate into the cover; and moving a center area of the cover towards the soleplate to thereby deform the cover such that the cover is moved against a portion of the soleplate located under the cover.

In accordance with another method of the present invention a method of assembling an iron is provided comprising steps of deforming a portion of a soleplate against a portion of a steam chamber cover; and causing an auditory sound to be generated from a fracture of the soleplate proximate the portion of the soleplate when a bad seal occurs to thereby signal an operator of an occurrence of the bad seal between the soleplate and the cover.

In accordance with another method of the present invention a method of attaching a steam chamber cover to a soleplate for an iron is provided comprising steps of providing a tool die with a frame having a surface for contacting and deforming a portion of the soleplate, and a spring loaded stamp on the frame; and pressing the tool die on the soleplate and cover, the surface of the frame deforming the portion of the soleplate against the cover and the spring loaded stamp pressing the cover towards the soleplate.

BRIEF DESCRIPTION OF THE DRAWINGS

The foregoing aspects and other features of the present invention are explained in the following description, taken in connection with the accompanying drawings, wherein:

FIG. 1 is a perspective view of a soleplate and steam chamber cover assembly for an iron incorporating features of the present invention;

FIG. 3 is a cross-sectional view of the soleplate and cover assembly shown in FIG. 1 taken along line 3—3;

FIG. 3A is an enlarged view of area 3A shown in FIG. 3;

DETAILED DESCRIPTION OF THE PREFERRED EMBODIMENT

Figure 2A:
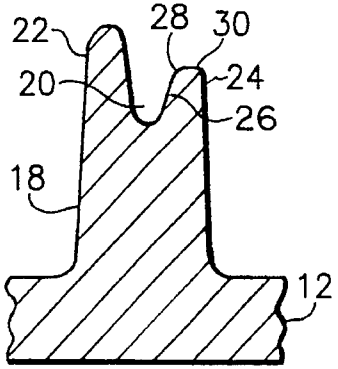
FIG. 2A is a cross-sectional view of the soleplate shown in FIG. 2 taken along line 2A—2A.

Referring to FIG. 1, there is shown a perspective view of a soleplate and steam chamber cover assembly 10 for an iron incorporating features of the present invention. Although the present invention will be described with reference to the single embodiment shown in the drawings, it should be understood that the present invention may be embodied in various different forms of alternate embodiments. In addition, any suitable, size or type of materials or elements could be used.

The assembly 10 generally comprises the soleplate 12 and the steam chamber cover 14. The rest of the iron is not described herein because it is well known in the art. The soleplate 12 is preferably a cast member made of a metallic material or alloy such as LM2, A380 or A383. The soleplate 12 has a heating element 16 that is embedded in the soleplate when it is cast. Referring also to FIGS. 2, 2A, 3 and 3A, the soleplate 12 has a raised steam chamber wall 18 extending from its top. The wall 18 has a general triangular loop shape.

Figure 2:
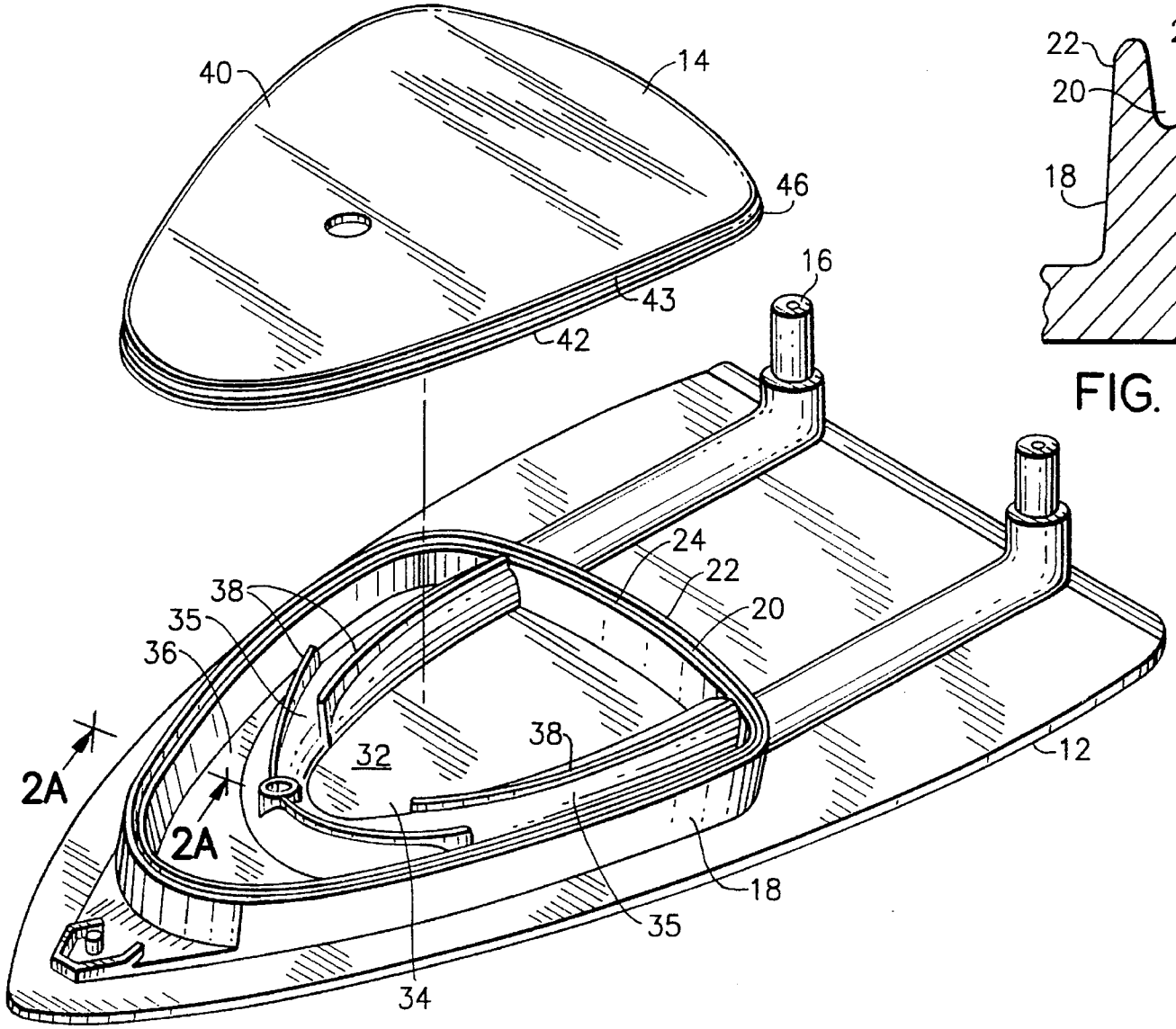
FIG. 2 is an exploded perspective of the soleplate and cover shown in FIG. 1 prior to connection of the cover to the soleplate.

FIGS. 2 and 2A show the soleplate 12 before connection with the cover 14. The top of the wall 18 has a channel 20 therein. The wall 18 has a first section 22 on the outer side of the channel 20 and a second section 24 on the inner side of the channel 20. The first section 22 is initially taller than the second section 24; at least before connection of the cover with the soleplate. The second section 24 has a side surface 26 in the channel 20 that is sloped. The second section 24 also has a curved surface 28 between the sloped surface 26 and the top 30 of the second section 24. The wall 18 forms an area 32 intended to function as a steam chamber. The heating element 16 extends through the rear of the wall 18 to form a first area 34 and a second area 36. The first area 34 is preferably coated with a surface treatment to break down water tension, such as silica dioxide. The top of the soleplate, above the heating element 16 in the area 32 has ribs 38. When the cover 14 is connected to the soleplate 12, the ribs 38 help to keep the two areas 34, 36 separated except at paths 35 through the ribs 38. At area 36 the soleplate 12 has holes or exit ports (not shown) to allow steam to exit the steam chamber area 32 and be directed onto the surface of an underlying object to be ironed.

The cover 14 is preferably made of sheet metal. The cover 14 has a flat center 40, at least before its connection to the soleplate 12, and a perimeter rim 42. The center 40 has a hole 44. The hole 44 allows water from a reservoir (not shown) to be dropped into the area 34. The rim 42 has a downward ledge 43 that extends down from the center 40 and an outwardly extending flange 46. The ledge 43, as seen in FIG. 3A, is angled at a slope or angle A of about 16°. However, any suitable angle could be provided. The sloped shape of the ledge 43 allows the die 50 to cover substantially the entire width of the channel 20 without hitting the center 40 of the cover 14. The cover 14 has a general triangular shape and is suitably sized and shaped to be placed on top of the soleplate with the rim 42 being received, at least partially, in the channel 20.

Referring particularly to FIGS. 2A, 3 and 3A, the cover 14 is placed on the soleplate 12 with the flange 46 in the channel 20. The first section 22 at the top of the wall 18 is then deformed. More specifically, the first section 22 is pressed down and pressed in along the entire wall 18. This causes the first section 22' to be formed to clamp the flange 46 of the cover 14 against the bottom of the channel 20 and causes the downward ledge 43 to be sandwiched between the first section 22' and the second section 24. When completed, the height of the first section 22' is substantially the same as the height of the second section 24. The sloped surface 26 was provided to allow the inner edge 48 of a deforming toot 50 (see FIG. 3A) to be located above the entire width of the bottom of the channel 20. The curved surface 28 has been provided to allow the cover 14 to more easily bend in at the surface 28. Using a sharp turn between top 30 and surface 26 has been found to result in the second section 24 breaking. Use of the curved surface 28 has been found to prevent the second section 24 from breaking. As seen best in FIG. 3A, the height of the ledge 43 is larger than the height of the second section 24 from the bottom of the channel 20. Thus, when the rim 42 is positioned in the channel 20, a space B is established between the bottom of the center 40 and the top of the second section 24. This space B allows tolerances to be larger than they otherwise would be by helping to prevent the center 40 from being moved down by the frame of the deforming tool 50. The space B and slope A combine to allow the tool 50 to properly deform the soleplate to provide a good seal, but allow greater tolerances to be used to keep manufacturing costs down. The connection described above has been found to be both mechanically strong and form an adequate seal in the channel 20 between the cover and soleplate without the use of additional fasteners and/or adhesive/sealant. The seal has been found to pass a pressure test of losing less than 0.25 psi in two seconds under air pressure of 1 psi. This has been found to be a sufficient test for the seal between the soleplate and steam chamber cover. Because the edge of the center 40 of the cover 14 is moved slightly inward, the center 40 bows upward as seen by 40' in FIG. 3. However, the cover 14 should contact the top of the ribs 38 to keep the two areas 34, 36 separated (except through paths 35) (see FIG. 2). In order to return the center 40' to its flat shape 40, the top of the center 40' is stamped towards the soleplate to deform the center back to its flat shape 40. The center 40 thus rests on the ribs 38 as seen in FIG. 3. FIG. 1 shows an embodiment where the cover 14 has been stamped with sufficient force to form upwardly extending indentations 52 in the cover. This may provide a better seal between the ribs 38 and cover 14 than the non-indented version shown in FIG. 3.

Figure 4:
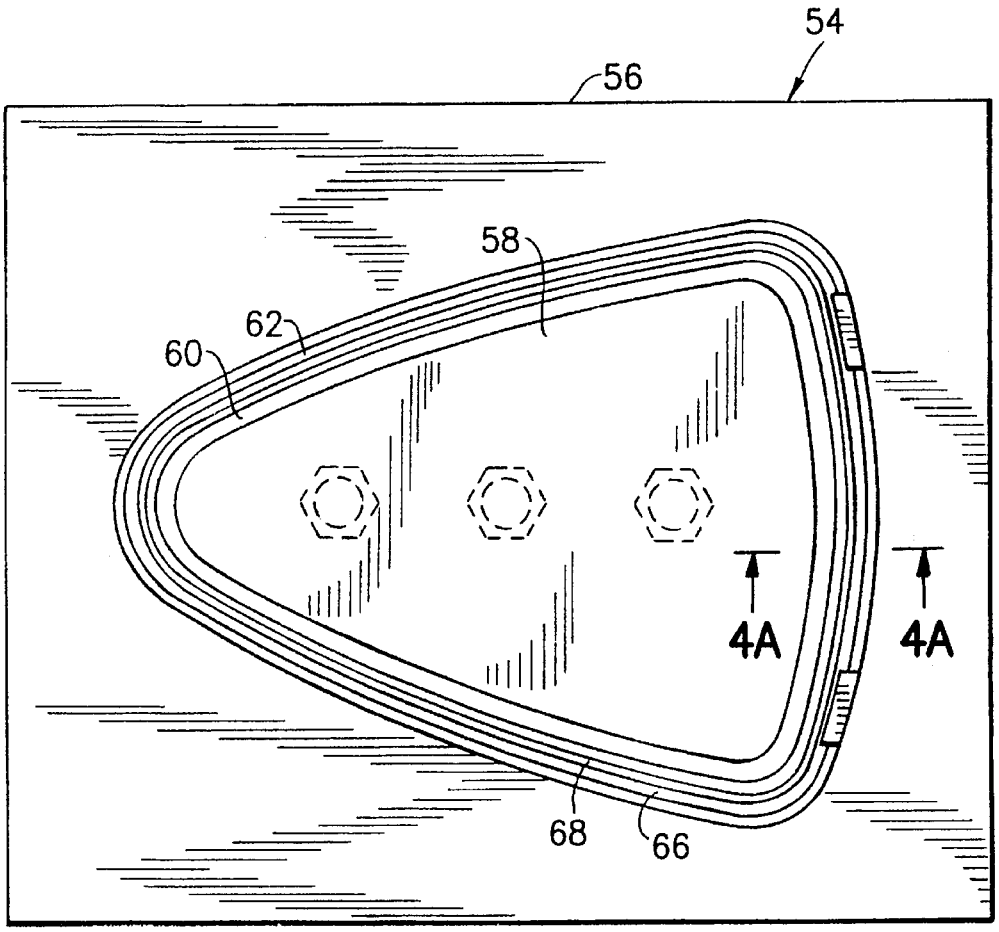
FIG. 4 is a bottom plan view of a tool die used to connect the cover to the soleplate shown in FIG. 1.
Figure 4A:
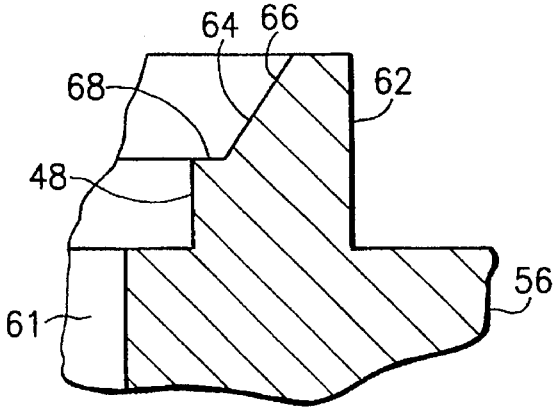
FIG. 4A is an enlarged cross-sectional view of the tool die shown in FIG. 4 taken along line 4A—4A.
Figure 4B:
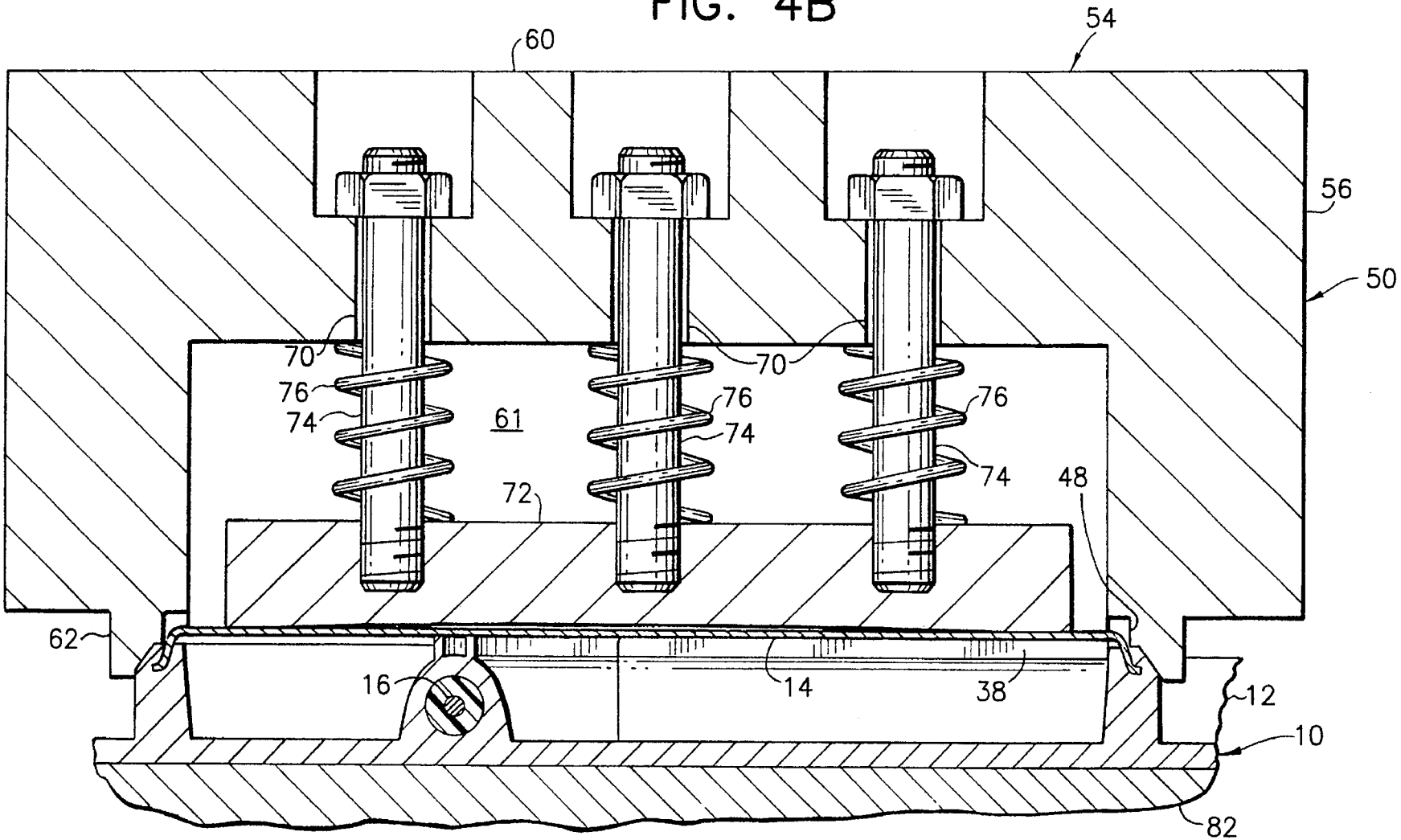
FIG. 4B is a cross-sectional view of the tool die shown in FIG. 4 shown connecting the soleplate and cover of the assembly shown in FIG. 1 to each other.

Referring now to FIGS. 4, 4A and 4B, the tool 50 is shown comprising a tool die 54 for connecting the cover and soleplate to each other. The die 54 includes a frame 56 and a stamp 58. The frame 56 is made of metal and includes a center area 60 with a recess 61 in its bottom and a raised area 62 on its bottom surface that surrounds the recess 61. The raised area 62 has a surface 64 for contacting and deforming the first section 22 of the soleplate 12. The surface 64 has a first sloped section 66 and a second flat section 68°. The raised area 62 has a general triangular loop shape that is about the same size as the wall 18 of the soleplate 12. The frame 56 has holes 70 through the center area 60 into the recess 61. The stamp 58 has a stamp member 72, bolts 74 and springs 76. The bolts 74 are attached to the stamp member 72 and extend through the holes 70. The springs 76 bias the stamp member 72 at an extended position from the top of the recess 61. However, the bolts 74 are slidingly mounted in the holes 70 such that the stamp member 72 can be moved towards the top of the recess 61 with compression of the springs 76.

Figure 5:
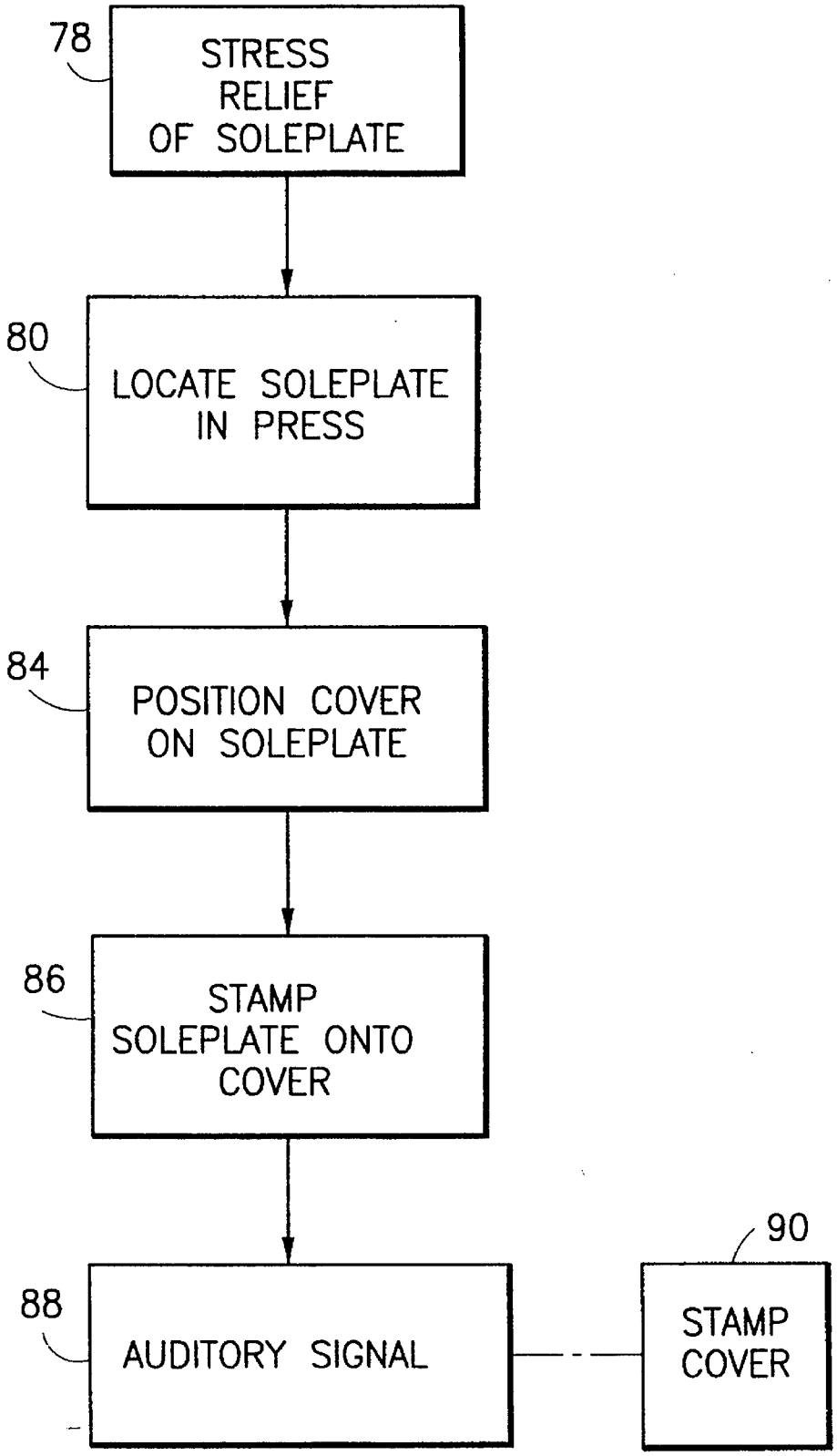
FIG. 5 is a schematic diagram of the method used to connect the cover and soleplate to each other.

Referring also to FIG. 5, the soleplate 12 is preferably subjected to stress relief as indicated by box 78 prior to connection of the cover 14. Preferably the stress relief process comprises heating the soleplate at 700° F. for about twenty minutes. However, any suitable type of stress relief or annealing process could be used. Alternatively, stress relief does not need to be used if the soleplate is made of a suitable material. After stress relief 78, the soleplate 12 is located in a press 82 that has the tool die 54 as indicated by box 80. The press 82 preferably has a seat or nest to precisely position the soleplate below the tool die 54. The cover 14 is then positioned on the soleplate 12 with the rim 42 extending into the channel 20 as indicated by box 84. The press 82 is then operated to stamp the soleplate 12 onto the cover 14 as indicated by box 86. As the first section 22 is moved in and down, slight fractures C (see FIG. 3A) occur. However, these fractures C are only partial fractures. Therefore, the mechanical connection and the good seal described above is not interfered with. If, for some reason, the fractures extend entirely through the width of the first section 22, a bad seal is formed. However, the method described above allows instantaneous discovery of the bad seal. More specifically, when the fractures extend entirely through the first section 22, an auditory signal is generated as illustrated by box 88. In particular, a loud bang noise is heard which indicates to the operator that a bad seal has been formed between the soleplate and the cover. If the operator hears the loud band auditory signal, he or she will discard the soleplate and cover knowing it to have a bad seal. If the loud band auditory signal is not heard, the operator knows that a good seal has been formed between the soleplate and the cover. The loud bang occurs when a fracture extends entirely through the first section 22, but does not occur when only the partial fractures are formed. The stamp 58 stamps the top of the cover 14 to press it down against the ribs 38 as indicated by box 90. The springs 76 can be varied to select a desired force to stamp the cover 14. To produce a flat top cover the springs 76 are selected to produce a force of about 3 to 4 tons. To produce a cover with the upwardly extending indentations 52 (see FIG. 1) the springs 76 are selected to produce a force of about 4 to 6 tons. The force applied by the surface 64 against the soleplate 12 is about 30 tons. In an alternate embodiment the tool die need not have the stamp 58. The cover could be stamped at another manufacturing station. Alteratively, the cover need not be stamped at all if it is designed to properly sit on the ribs 38 after the wall 18 is deformed, or if any gap between the cover 14 and the ribs 38 is small, or if the gap between the cover 14 and ribs 38 is intended to replace the paths 35.

When the surface 64 contacts and deforms the first section 22 at the top of the wall 18, the sloped surface 66 deforms the first section 22 inward towards the second section 24. The second flat section 68, which is located over the entire width of the bottom of the channel 20, pushes the first section of the wall 18 down into the channel. These two actions allow the flange 46 to be clamped against the bottom of the channel and, sandwiches a portion of the rim 42 between the first section 22' and the second section 24. This results is a mechanically strong connection and a good seal between the cover and the soleplate.

Unlike prior connection systems, the present invention does not use rivets, bosses or screws. The present invention does not need adhesive and or sealant between the cover and soleplate. In the past, assembly that used silicon sealants needed to be carefully monitored because the sealant could damage or inhibit the surface treatment for water tension breakdown used in area 34. The present connection system is thus easier to manufacture and less costly to manufacture. Of course, the connection system of the present invention could be used with different types of soleplates and covers. This could include different shaped steam chamber walls, steam chamber cover rims, perhaps even a soleplate without a steam chamber wall if the base of the soleplate had a channel with a raised section to function similar to the first section 22. The connection system of the present invention could also be used with fasteners and/or adhesive sealant if desired.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. An iron comprising:

a steam chamber cover; and a soleplate having a perimeter of the cover located in a channel of the soleplate, the channel extending into a portion of a top of the soleplate, the portion having a first section located on an outer side of the channel and a second section located on an inner side of the channel, the height of the first section being relatively greater than the height of said second section before said first section is deformed, said first section being deformed against the perimeter of the cover wherein the first and second sections have substantially the same height after the first section is deformed.

2. An iron as in claim 1 wherein the perimeter of the cover has an outwardly extending flange.

3. An iron as in claim 2 wherein the outwardly extending flange is clamped by the first section against a bottom of the channel and a portion of the perimeter of the cover is sandwiched between the first and second sections.

4. An iron as in claim 1 wherein the portion of the soleplate is a raised steam chamber wall with the channel being located in a top of the wall.

5. An iron as in claim 1 wherein at least a portion of the perimeter of the cover is sandwiched between the first and second sections.

6. An iron as in claim 1 wherein the second section has a surface at the channel that is sloped.

7. An iron as in claim 6 wherein the second section has a curved surface between a top of the second section and the sloped surface of the second section.

8. An iron as in claim 1 wherein the cover contacts areas of the soleplate in a steam chamber formed by the cover and the soleplate, the areas in the steam chamber being spaced from the steam chamber wall.

9. An iron as in claim 8 wherein the cover has upwardly extending indentions formed by the areas of the soleplate.

10. A method of assembling an iron comprising steps of:

providing a soleplate with a channel on its top, a first section of the soleplate at a first side of the channel being higher than a second section of the soleplate at a second side of the channel;

locating a steam chamber cover on the top of the soleplate, the cover having a rim that is located inside the channel; and deforming the first section of the soleplate into the channel to sandwich the rim between the first and second sections of the soleplate.

11. A method as in claim 10 wherein the rim has an outwardly extending flange that is clamped by the first section against a bottom of the channel.

12. A method as in claim 10 wherein the deforming step includes stamping the cover against areas of the soleplate located inside a steam chamber formed by the soleplate and cover.

13. A method as in claim 12 wherein the step of deforming the first section and the step of stamping the cover are performed by use of a single combined tool die.

14. A method as in claim 12 wherein the step of stamping the cover forms upwardly extending indentations in the cover from contact with the areas of the soleplate inside the steam chamber.

15. A method of assembling an iron comprising steps of:

connecting a steam chamber cover to a soleplate by deforming a portion of the soleplate onto the cover; and moving a center area of the cover towards the soleplate to thereby deform the cover such that the cover is moved against a portion of the soleplate located under the cover.

16. A method as in claim 15 wherein the step of moving a center area of the cover forms upwardly extending indentations in the cover from contact of the cover with areas of the soleplate located under the cover.

17. A method as in claim 15 wherein the step of connecting and the step of moving occur substantially simultaneously.

18. A method of assembling an iron comprising steps of:

deforming a portion of a soleplate against a portion of a steam chamber cover; and causing an auditory sound to be generated from a fracture of the soleplate proximate the portion of the soleplate when a bad seal occurs to thereby signal an operator of an occurrence of the bad seal between the soleplate and the cover.

* * * * *